United States Patent [19]

Takahashi et al.

[11] 4,105,868

[45] Aug. 8, 1978

[54] AM STEREOPHONIC TRANSMISSION SYSTEM

[75] Inventors: Susumu Takahashi; Hirotaka Kurata, both of Tokyo, Japan

[73] Assignee: Sansui Electric Co., Ltd., Tokyo, Japan

[21] Appl. No.: 753,299

[22] Filed: Dec. 22, 1976

[30] Foreign Application Priority Data

Dec. 26, 1975 [JP] Japan ..... 51-158605
Dec. 26, 1975 [JP] Japan ..... 51-158607

[51] Int. Cl.[2] ..... H04H 5/00
[52] U.S. Cl. ..... 179/15 BT
[58] Field of Search ..... 179/15 BT; 325/36, 47; 343/200, 205, 207

[56] References Cited

U.S. PATENT DOCUMENTS

| | | | |
|---|---|---|---|
| 2,960,573 | 11/1960 | Hodgson et al. | 179/15 BT |
| 3,102,167 | 8/1963 | Barton | 179/15 BT |
| 3,231,672 | 1/1966 | Collins et al. | 179/15 BT |
| 3,732,375 | 5/1973 | Kuribayashi | 179/15 BT |
| 3,803,490 | 4/1974 | Almering et al. | 179/15 BT |

*Primary Examiner*—Douglas W. Olms
*Attorney, Agent, or Firm*—Harris, Kern, Wallen & Tinsley

[57] ABSTRACT

An AM sterophonic broadcast signal for transmitting stereophonically related first and second audio information signals to at least one receiver comprises a first carrier component, a double-sideband component of a second carrier component being suppressed-carrier amplitude-modulated by the first audio information signal and a double-sideband component of a third carrier component being suppressed-carrier amplitude-modulated by the second audio information signal phase-shifted by 90 degree relative to the first audio information signal. The second and third carrier components have the same frequency as the first carrier component and their phases are advanced and retarded in phase by 45° with respect to the first carrier component respectively. The AM stereophonic broadcast is compatible with an existing AM monophonic receiver. An AM stereophonic receiver compatible with an existing AM monophonic broadcast is also disclosed.

15 Claims, 13 Drawing Figures

AM STEREOPHONIC TRANSMISSION SYSTEM

The present invention relates to an AM stereophonic transmission system compatible with an existing AM monophonic receiver.

Diverse AM stereophonic transmission systems have been proposed. Two types of such transmission system will be referred to here. The first is the FAM stereophonic transmission system described in "A Compatible Stereophonic System for AM Stereo Band" by J. AVINS, L.A. FREEDMAN et al, in RCA REVIEW, Aug. 1, 1960. In this system, a carrier wave signal is amplitude-modulated by the sum of stereophonically related audio signals L and R, and is frequency-modulated by the difference of the audio signals L and R. The frequency spectrums in the stereophonic and monophonic broadcasts in this system are shown in FIGS. 1A and 1B, respectively. In the figure, the carrier frequency is designated by *fc* and the maximum frequency of the audio signal by *fl*. The conventional monophonic receiver can reproduce the sum L+R of audio signals from the received amplitude-modulated signal so that the FAM stereophonic broadcast is compatible with the conventional AM receiver.

The second is the AM stereophonic transmission system called the ISB (Independent Sideband) system or the SSB - SSB system described in "A stereophonic system for Amplitude-Modulated Broadcast Stations" by Leonard R. Kahn in IEEE Transactions on Broadcasting, June, 1971.

In this system, a first carrier is amplitude-modulated by the sum of the audio signals L and R, and a second carrier quadrature in phase with the first carrier is double-sideband suppressed-carrier amplitude-modulated by the difference $j(L - R)$ between the audio signals which is phase-shifted by 90° relative to the sum of the audio signals. Then, the L + R modulated carrier and the double-sideband suppressed-carrier amplitude-modulated $j(L - R)$ signal are added together so that the left audio signal L is transmitted by the lower sideband of AM wave while the right audio signal R by the upper sideband of the AM wave. The frequency spectrums in the stereophonic and the monophonic broadcasts in this transmission system are shown in FIGS. 2A and 2B, respectively. The ISB stereophonic transmission system is also compatible with the conventional monophonic receiver, although the reproduction of L + R signal by the conventional receiver is accompanied by a small amount of distortion.

As will be evident from FIGS. 1A, 1B, 2A and 2B, in both the FAM and ISB system, the occupied bandwidth for stereophonic broadcast is equal to that for monophonic broadcast. From the standpoint of effective utilization of frequency bands, the occupied bandwidth for monophonic broadcast is desired to be half the bandwidth for stereophonic broadcast because the amount of information transmitted by the monophonic broadcast is half that transmitted by the stereophonic broadcast.

The conventional monophonic receiver insufficiently reproduces an opposite-phase signal included in the audio signals L and R, in either system of FAM or ISB. Particularly, when the opposite-phase signal is distributed to left and right channels at an equal amplitude level, it is impossible to reproduce such signal. In a matrix four-channel stereophonic system, a rear signal is distributed in the opposite-phase relationship to the stereophonic channels. When the stereophonic signals from a stereo disc recorded by such a system is broadcasted, the monophonic receiver reproduces insufficiently the rear signal.

An object of the present invention is to provide an AM stereophonic transmission system whose occupied bandwidth in the monophonic broadcast is half of that in the stereophonic broadcast.

Another object of the present invention is to provide an AM stereophonic transmission system permitting a conventional monophonic receiver to fully reproduce an opposite-phase signal included in the stereophonic signals.

Still another object of the present invention is to provide an AM stereophonic receiver which is compatible with a conventional AM monophonic broadcast.

According to one aspect of the present invention, there is provided an AM stereophonic transmission system for transmitting stereophonically related first and second audio information signals by an amplitude modulation system, in which a broadcast signal to be transmitted to at least one remote receiver includes: a first carrier component; a first double-sideband component of a second carrier component which is suppressed-carrier amplitude-modulated by the first audio information signal, the second carrier component having the same frequency as that of the first carrier component and being advanced in phase by substantially 45° with respect to the first carrier component; and a second double-sideband component of a third carrier component which is suppressedcarrier amplitude-modulated by a second audio information signal phase-shifted by substantially 90° relative to the first audio information signal, said third carrier component having the same frequency as that of the first carrier component and being retarded in phase by substantially 45° with respect to the first carrier component.

A transmitter for forming the broadcast signal according to an emobidment of the present invention comprising: a source of stereophonically related first and second audio information signals; phase shift means for phase shifting the first and second audio information signals to provide a relative phase shift of substantially 90° therebetween; means for summing the phase shifted first and second audio information signals to produce a sum of the phase shifted first and second audio information signals; means for producing a difference of the phase shifted first and second information signals, means for generating first and second carriers having a relative phase shift of 90° therebetween; first modulation means for amplitude-modulating the first carrier from the carrier generating means by the sum of first and second audio information signals; second modulation means for double-sideband suppressedcarrier amplitude-modulating the second carrier signal from the carrier signal generating means by the difference signal of the phase shifted first and second audio information signals; and means for composing output signals of the first and second modulation means.

A transmitter for forming the broadcast signal according to a second embodiment of the present invention comprising; a source of stereophonically related first and second audio information signals; phase shift means for phase shifting the first and second audio information signals to provide a relative phase shift of 90° therebetween; means for generating first, second and third carrier signals, the second and third carrier signals being phase-shifted relative to the first carrier signal by +45° and −45°, respectively; first modulation means for double-sideband suppressed-carrier amplitude-modulating the second carrier signal by the phase shifted first audio information signal; second modulation means for double-sideband suppressed-carrier amplitudemodulating the third carrier signal by the phase shifted second audio information signal; ans summing means for summing the output signals of the first and second modulation means and the first carrier signal from the carrier signal generating means.

Other features and objects of the present invention will be apparent from the following description taken in connection with the accompanying drawings, in which.

Figure 1A:
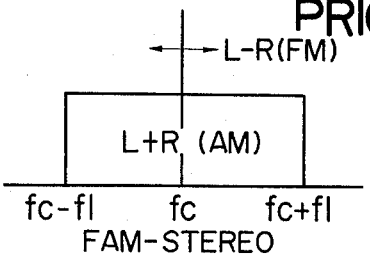
FIG. 1A PRIOR ART
FIGS. 1A and 1B illustrate frequency spectrums in the stereophonic broadcast and the monophonic broadcast by a prior art AM sterephonic transmission system.
Figure 1B:
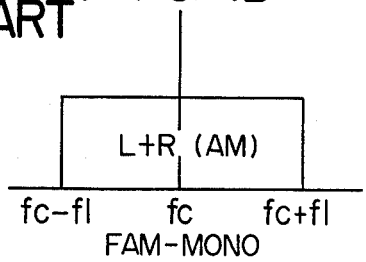
Figure 2A:
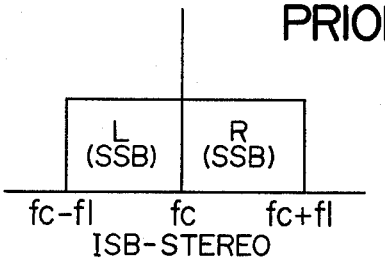
FIG. 2A PRIOR ART
FIGS. 2A and 2B show frequency spectrums in the stereophonic and monophonic broadcasts by another prior art AM stereophonic transmission system.
Figure 2B:
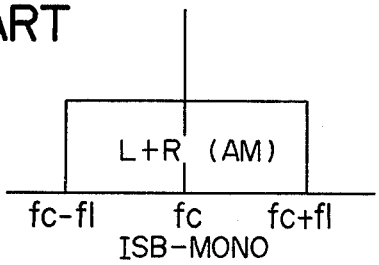
Figure 3:
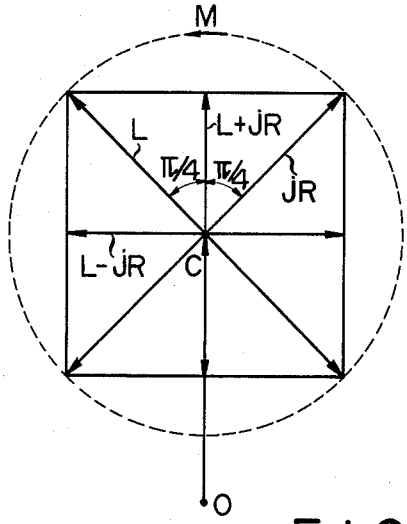
FIG. 3 is a vector diagram for illustrating an AM transmission system acccording to the present invention.

The principle of an AM stereophonic transmission system according to the present invention will be explained with reference to FIG. 3 of a vector diagram. In the present invention, a carrier signal OC is amplitude-modulated by an audio composite signal (L + $j$R), while at the same time a carrier signal in phase quadrature with the carrier OC is double-sideband suppressed-carrier amplitude-modulated by an audio composite signal (L - $j$R), and then L + $j$R modulated carrier and the double-sideband suppressed carrier amplitudemodulated L - $j$R signal are summed. Here, L designates a left audio signal, R a right audio signal and $j$ denotes the phase shift of 90°.

As seen from the vector diagram, this system is equivalent to the following system. That is, a carrier displaced in phase by + 45° with respect to the carrier OC is doulbesideband supprssed-carrier amplitude-modulated by the signal L, while a carrier displaced in phase by −45° with respect to the carrier OC is double-sideband suppressedcarrier amplitude-modulated by the signal $j$R, and then the carrier OC, the double-sideband suppressed-carrier amplitude-modulated L signal and the double-sideband suppressed-carrier amplitude-modulated $j$R signal are synthesized.

Figure 4A:
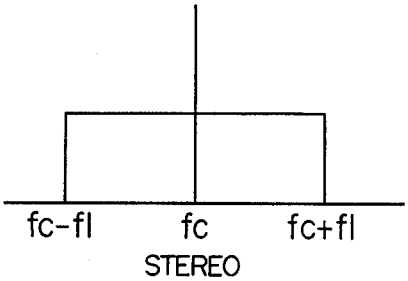
FIG. 4A illustrates the frequency sprectrum of a modulated wave in the AM stereophonic broadcast according to the present invention.
Figure 4B:
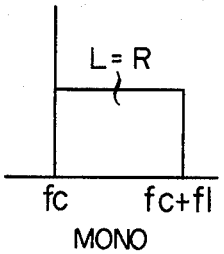
FIGS. 4B and 4C illustrate the frequency spectrum of a modulated wave in the AM monophonic broadcast.
Figure 4C:
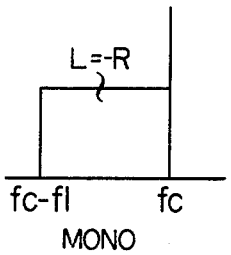

The frequency spectrum in the stereophonic broadcast by the AM stereophonic transmission system according to the present invention is shown in FIG. 4A and the occupied bandwidth thereof is equal to that of the conventional AM monophonic braodcast. As mentioned above, in the AM stereophonic transmission system according to the present invention, two double-sideband (DSB) signals are in phase-quadrature with respect to each other, and the modulation signals L and $j$R have a relative phase shift of 90° therebetween. Accordingly, when $L = R$, i.e. in the monophonic broadcast, the modulated wave consists of the carrier and upper sideband component. When $L = -R$, the modulated wave consists of the carrier and lower sideband component. The modulated wave vector in the monophonic broadcast ($L = R$) rotates counterclockwise as indicated by M of FIG. 3. When $L = -R$, the vector rotates clockwise. FIGS. 4B and 4C illustrate the frequency spectrums when $R = L$ and $R = -L$, respectively. The magnitude of the spectrum is the sum of the upper sideband produced when the carrier is modulated by only the audio composite signal L and that when it is modulated by only the signal R. Accordingly, there is no difference of the amount of information to be transmitted between the stereophonic and monophonic broadcast. The monophonic broadcast by using the AM stereophonic transmission system needs only half of the bandwidth of the stereophonic broadcast. Further, note that the monophonic broadcast by the AM stereophonic transmission system of the present invention can be received by conventional AM receivers using the envelope detector.

Figure 5:
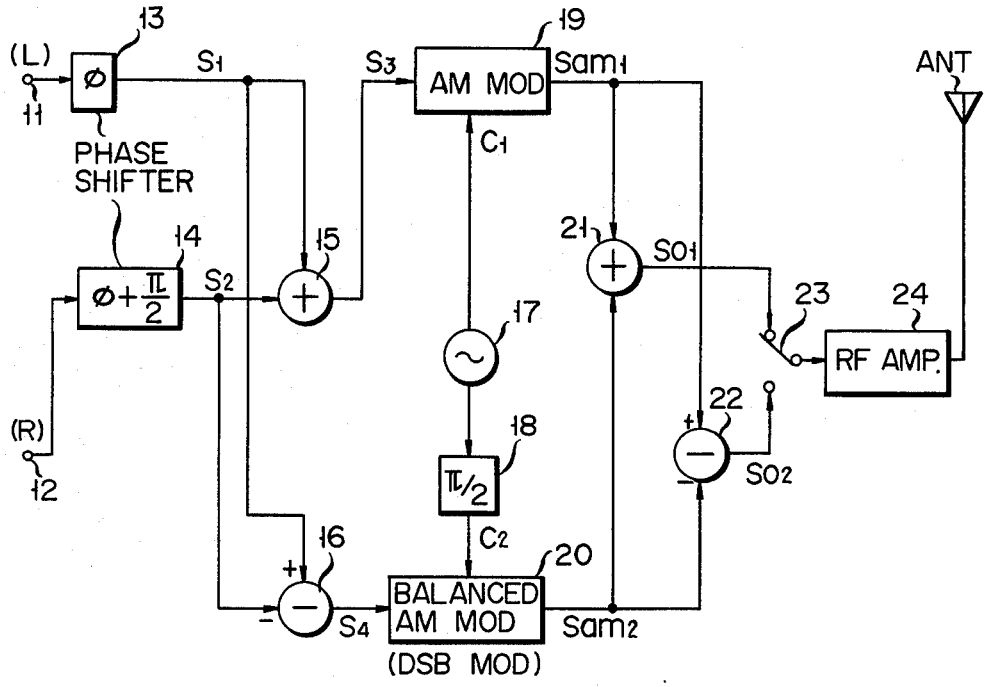
FIG. 5 illustrates in the block form an embodiment of an AM stereophonic transmitter according to the present invention.

Referring now to FIG. 5, there is shown a transmitter embodying the AM stereophonic transmission system according to the present invention. In the figure, reference numerals 11 and 12 are input terminals for receiving the left and right channel signals L and R fed from a stereophonic audio source. A phase shifter designated by reference numeral 13 shifts the phase of the left signal L by the reference phase shift angle $\phi$, and a phase shifter 14 is used to phase-shift the right signal R by the phase angle of the reference phase shift angle $\phi$ plus 90°. The right and left audio signals phase-shifted are added together in an adder 15 to produce a sum signal L + $j$R. At the same time, those phase shifted audio signals are fed to a subtractor 14 where a difference signal L − $j$R is produced. A carrier generator 17 is connected at one end to a phase shifter 18 which phase-shifts the carrier by +90°. The generator 17 is connected at the other end with an AM modulator 19 where the carrier from the generator 17 is amplitude-modulated by the sum signal L + $j$R. The difference signal L − $j$R is fed to a balanced modulator 20 where the 90° phase shifted carrier given from the phase shifter 18 is double-sideband suppressed-carrier amplitude-modulated by the difference signal. The output of the AM modulator 19 and the DSB output of the balanced modulator 20 are applied to an adder 21 and a subtractor 22, respectively. The outputs of the adder 29 and the subtractor 22 are fed to a transmitting antenna ANT through a switch 23 and a RF power amplifier 24.

With the expressions of the audio signals L and R inputted to the input terminals 11 and 12, L = l sinωlt and R = $r$ sinωrt, the outputs of the phase shifters 13 and 14 are given by:

$$s_1 = l\sin(\omega l\, t + \phi) = l\sin\Omega l\, t$$

$$S_2 = r\sin(\omega rt + \phi + \pi/2) = r\sin(\Omega rt + \pi/2)$$

where $\omega lt + \phi = \Omega lt$ and $\omega rt + \phi = \Omega rt$.

Accordingly, the output $S_3$ of the adder 15 and the output $S_4$ the subtractor 16 are expressed as follows:

$$S_3 = S_1 + S_2 = l\sin\Omega lt + r\cos\Omega rt\ (= L + jR)$$
$$S_4 = S_1 - S_2 = l\sin\Omega lt - r\cos\Omega rt\ (= L - jR)$$

When the carrier signal $C_1$ of the carrier generator 17 is $$C_1 = \xi\sin\omega t$$

the output $C_2$ of the phase shifter 18 is $$C_2 = \xi\sin(\omega t+\pi/2) = \xi\cos\omega t$$

The output Sam 1 of the AM modulator 19 is $$Sam\ 1 = (S_3 + 1)\ C_1 = \{(l\sin\Omega lt + r\cos\Omega rt) + 1\}\xi\sin\omega t$$

The output Sam 2 of the DSB modulator 20 is $$Sam\ 2 = S_4 \cdot C_2 = (l\sin\Omega lt - r\cos\Omega rt)\cdot\xi\cos\omega t$$

Accordingly, the output signal Sol of the adder 21 is expressed as follows:

$$\begin{aligned} SO1 &= Sam\ 1 + Sam\ 2 \\ &= \xi\sin\omega t + L\sin\Omega lt \cdot \xi(\sin\omega t + \cos\omega t) \\ &\quad + r\cos\Omega rt \cdot \xi(\sin\omega t - \cos\omega t) \\ &= \xi\sin\omega t + l\sin\Omega lt \cdot \sqrt{2}\ \xi\sin(\omega t + \pi/4) + \\ &\quad r\cos\Omega rt \cdot \sqrt{2}\ \xi\sin(\omega t - \pi/4) \\ &= \xi\sin\omega t + \epsilon l \cdot \frac{\sqrt{2}}{2}\ [\mathrm{COS}\{(\omega - \Omega l)t + \pi/4\} - \\ &\quad \cos\{(\omega + \Omega l)t + \pi/4\}] + \\ &\quad \xi r \frac{\sqrt{2}}{2}\ [\sin\{(\omega - \Omega r)t - \frac{\pi}{4}\} + \\ &\quad \sin\{(\omega + \Omega r)t - \frac{\pi}{4}\}] \end{aligned}$$

This equation shows that the output signal Sol of the a double-adder 21 includes a first carrier $\xi\sin\omega t$, a double-sideband signal $l\sin\Omega lt\cdot\xi\sin(\omega t+\pi/4)$ of a second carrier which is phase-displaced by $+45°$ with respect to the first carrier $\xi\sin(\omega t+\pi/4)$ and is suppressed-carrier amplitude-modulated by the signal L, and a double-sideband signal $r\cos\Omega rt\cdot\xi\sin(\omega t-\pi/4)$ of a third carrier which is phase-displaced by $-45°$ with respect to the first carrier and is suppressed-carrier amplitude-modulated by the signal $jR$. rt·ξ

The output signal So2 of the subtractor 22 is given $$\begin{aligned} So\ 2 &= Sam\ 1 - Sam\ 2 \\ &= \xi\sin\omega t + l\sin\Omega lt \cdot \xi(\sin\omega t - \cos\omega t) + \\ &\quad r\cos\Omega rt \cdot \xi(\sin\omega t + \cos\omega t) \\ &= \xi\sin\omega t + l\sin\Omega lt \cdot \sqrt{2}\ \xi\sin(\omega t - \pi/4 + \\ &\quad r\cos\Omega rt \cdot \sqrt{2}\ \xi\sin(\omega t + \pi/4) \\ &= \xi\sin\omega t + \xi l \cdot \frac{\sqrt{2}}{2}\ [\cos\{(\omega - \Omega l)t - \pi/4\} - \\ &\quad \cos\{(\omega + \Omega l)t - \pi/4\}] \\ &\quad + \xi R \cdot \frac{\sqrt{2}}{2}\ \{\sin\{(\omega - \Omega r)t + \pi/4\} + \\ &\quad \sin\{(\omega + \Omega r)t + \pi/4\} \end{aligned}$$

As seen from the equation, the output signal So2 of the subtractor 22 includes a first carrier $\xi\sin\omega t$, a double-sideband signal $l\sin\Omega lt\cdot\sin(\omega t-\pi/4)$ of a second carrier $\xi\sin(\omega t-\pi/4)$ which is phase-displaced frpm the first carrier by $-45°$ and is suppressed-carrier amplitude-modulated by the signal L, and a double-sideband signal $r\cos\Omega rt\cdot\xi\sin(\omega t+\pi/4)$ of a third carrier $\xi\sin(\omega t+\pi/4)$ which is displaced in phase from the first carrier by $+45°$ and is suppressed-carrier amplitude-modulated by the signal $jR$.

The output of the adder 21 has a similar nature with that of the subtractor 22 so that either output of the adder or the subtractor may be transmitted as the stereophonic broadcast signal. In practical use, however, one of them should be selected. Thus, for practical broadcast, either one of the adder or subtractor and the switch 23 are unnecessary.

Explanation to follow is the monophonic broadcast using the FIG. 5 transmitter. Since $L = R$ in the monophonic broadcast, with $l=r=m$, and $\Omega l=\Omega r=\Omega m$, the output Sam 1 of the Am modulator 19 and the output Sam 2 of the balanced AM modulator 20 are expressed as follows:

$$Sam\ 1 = \{(m\mathrm{Sin}\Omega mt+m\cos\Omega mt) + 1\}\xi\sin\omega t$$

$$Sam\ 2 = (m\sin\Omega mt\text{-}m\cos\Omega mt)\xi\cos\omega t$$

Accordingly, the signals So1 and So2 are expressed as follows:

$$\begin{aligned} So1 &= Sam\ 1 + Sam\ 2 = \{\sin\omega t + \\ &\quad \sqrt{2}\ m\sin(\Omega mt + \pi/4)\ \xi\sin\omega t - \\ &\quad \sqrt{2}\ m\cos(\Omega mt + \pi/4) \cdot \xi\cos\omega t \\ &= \epsilon\sin\omega t - \sqrt{2}\ m\xi\cos\{(\omega + \Omega m)t + \pi/4\} \\ So2 &= Sam\ 1 - Sam\ 2 = \epsilon\sin\omega t + \\ &\quad \sqrt{2}\ m\sin(\Omega mt + \pi/4) \cdot \xi\sin\omega t + \\ &\quad \sqrt{2}\ m\cos(\Omega mt + \pi/4) \cdot \xi\cos\omega t \\ &= \xi\sin\omega t + \sqrt{2}\ m\xi\cos\{(\omega - \Omega m)t + \pi/4\} \end{aligned}$$

From those equations, it is seen that, in the case of monophonic broadcast, the output of the adder 21 includes the carrier wave and the upper sideband, and the output of the subtractor 22 includes the carrier wave and the lower sideband.

When $L = -R$, the signals So1 and So2 are expressed as follows:

$$So1 = \xi\sin\omega t+\sqrt{2}m\xi\cos\{(\omega-\Omega m)t + \pi/4\}$$

$$So2 = \xi\sin\omega t - \sqrt{2}m\xi\cos\{(\omega+\Omega m)\ t-\pi/4\}$$

That is, when $L = -R$, the output So1 of the adder 21 and the output So2 of the subtractor 22 include the carrier wave and the lower sideband, and the carrier wave and the upper sideband, respctively.

A second embodiment of the AM stereophonic transmitter according to the present invention will be given with reference to FIG. 6. In the figure, like portions are designated by like reference numerals in FIG. 5. In this example, two phase shifters 25 and 26 are connected between a DSB modulator 27 and the carrier generator 17 and between a DSB modulator 28 and the carrier generator 17. The phase shifter 25 shifts the phase of the carrier from the generator 17 by $+45°$ and the phase shifter 26 shifts the phase of the carrier by $-45°$. The $45°$ phase-shifted carrier is DSB modulated by the phase-shifted L signal in the DSB modulator or balanced modulator 27, while the $-45°$ phase-shifted carrier is modulated by the $90°$ phase-shifted R signal in the DSB or balanced modulator 28. The carrier signal from the carrier generator 17, the output signals of the balanced modulators 27 and 28 are summed in an adder 29 and the result of the summation is fed to the power amplifier 24. It will be understood that, in the FIG. 6 embodiment, the same broadcast signal as the signal So1 in FIG. 5 may be obtained.

Figure 6:
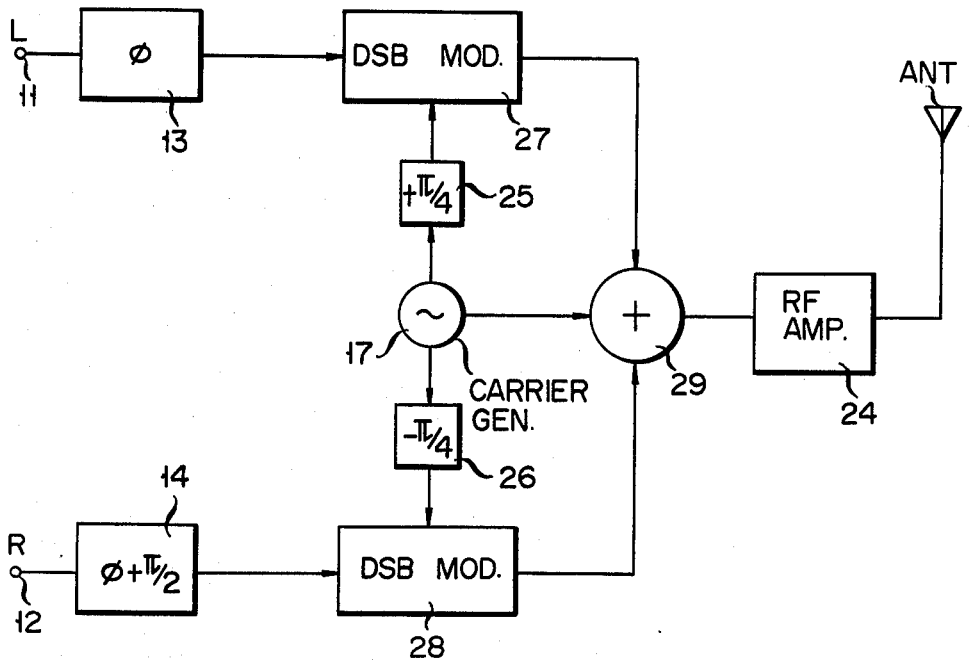
FIG. 6 shows a block diagram of another embodiment of the AM stereophonic transmitter according to the present invention.
Figure 7:
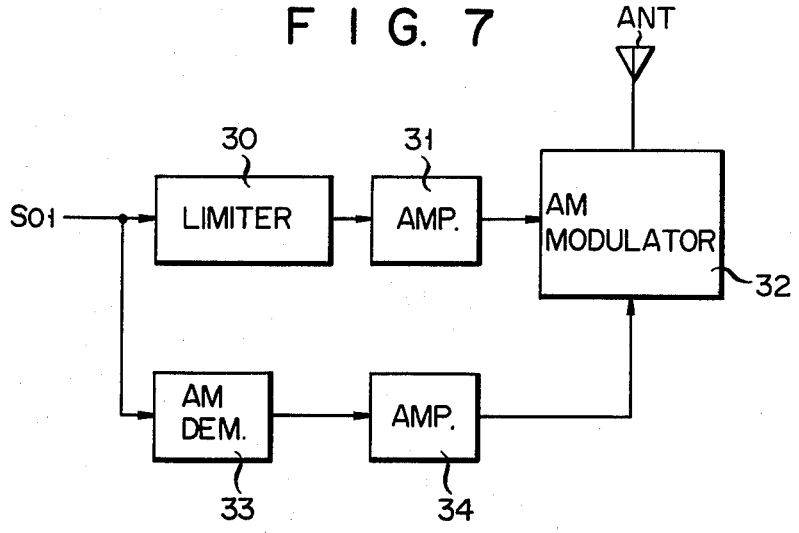
FIG. 7 illustrates an AM stereophonic transmitter for a high level signal transmission which may be used with the AM stereophonic tarnsmitter of the present invention.

The transmitters of FIGS. 5 and 6 are suitable for a low level transmission. For a high level transmission, the output of the AM modulator is preferably directly coupled with the transmission antenna, as in existing AM broadcasting stations. FIG. 7 shows a system for executing the high level transmission of the broadcast signal according to the present invention by using an AM modulator of an existing AM broadcasting station. The broadcast signal So1 obtained by the manner as shown in FIGS. 5 and 6 is applied to an amplitude limiter 30 to recover the carrier component. The carrier component recovered is applied through a suitable RF amplifier 31 to a high level AM modulator 32 directly coupled with the transmission antenna ANT. The broadcast signal So1 is also fed to the envelope detector 33 where an audio modulation signal is recovered. The audio modulated signal is applied through an audio amplifier 34 to the AM modulator 32 where the carrier is amplitude-modulated.

Description will now be made of an AM stereophonic receiver according to the present invention with reference to FIG. 8. An AM wave received by an antenna 40 is supplied to a front end including a RF amplifier 41 and a frequency converter 42 where it is converted into an intermediate frequency (for example, 455 kHz) signal, which is in turn fed to an intermediate frequency amplifier 43 to be amplified.

With $\omega o$ of the angular frequency of the intermediate frequency carrier, the output signal *Sdo*1 of the intermediate frequency amplifier 43 is given by:

$$Sdo1 = \xi\sin\omega ot + l\sin\Omega lt\cdot\sqrt{2}\xi\sin(\omega ot+\pi/4)+r\cos\Omega\lambda rt\cdot\sqrt{2}\xi\sin(\omega ot-\pi/4)$$

The amplifier 43 is connected with a synchronous carrier generator 44 which may be constituted by a PLL (phase-locked-loop) circuit where the intermediate frequency synchronous carrier *Cd* ($\mu\sin\omega ot$) is formed in synchronism with the intermediate frequency carrier included in the output signal Sdol. The synchronous carrier *Cd* is phase-shifted by the phase-shifters 45 and 46 by +45° and −45°. The synchronous carrier Cd1, $\mu\sin(\omega ot+\pi/4)$ from the phase shifter 45 is multiplied by the output signal Sdo1 of the amplifier 43 in a product detector 47 thereby to produce the output Sal. The output Sa1 is given by:

$$\begin{aligned} Sa1 &= Sdo\,1\cdot Cd1 \\ &= \frac{1}{2}\xi\cdot\mu\{\frac{1}{\sqrt{9}}\cos(2\omega ot+\pi/4)\}+ \\ &\quad \frac{\sqrt{2}}{2}\xi\cdot\mu l\sin\Omega lt - \\ &\quad \frac{\sqrt{2}}{2}\xi\cdot\mu\cdot l\sin\Omega lt\cdot\cos(2\omega ot+\pi/2) \end{aligned}$$

The DC component and high frequency component are removed from the signal Sa1 to obtain the audio component $$\frac{\sqrt{2}}{2}\xi\cdot\mu l\sin\Omega lt$$

corresponding to the left audio singal L.

The synchronous carrier C*d*2, $\mu\sin(\omega ot-\pi/4)$ from the phase shifter 46 is multiplied by the output signal Sdo1 of the amplifier 43 in a product detector 48 to produce the output signal S*a*2. The output S*a*2 is given by:

$$\begin{aligned} Sa2 &= Sdo1\cdot Cd2 \\ &= \frac{1}{2}\xi\cdot\mu\{\frac{1}{\sqrt{2}}-\cos(2\omega ot-\pi/4)\}+ \\ &\quad \frac{\sqrt{2}}{2}\xi\cdot\mu\cdot r\cos\Omega rt - \\ &\quad \frac{\sqrt{2}}{2}\xi\cdot\mu\cdot r\cos\Omega rt\cdot\cos(2\omega ot-\pi/2) \end{aligned}$$

The DC component and high frequency component are removed from the signal S*a*2 to obtain the audio component $\sqrt{\mu\cdot\rho\cdot r}\cos\Omega rt$ corresponding to the right audio signal *j*R.

The audio components from the product detectors 47 and 48 are coupled with respective output terminals 52 and 53 through a $\theta$ phase shifter 50 and $\theta-\pi/2$ phase shifter 51. The outputs Sao1 and Sao2 of the phase shifters 50 and 51 are given by:

$$Sao1 = \frac{\sqrt{2}}{2}\xi\cdot\mu\cdot l\sin(\Omega lt+\theta)$$

$$Sao2 = \frac{\sqrt{2}}{2}\xi\cdot\mu\cdot r\sin(\Omega rt+\theta)$$

The receiving of a single-sideband monophonic broadcast signal will be described hereinafter. The output signal Sdo1 of the intermediate frequency amplifier 43 in the monophonic broadcasting is $$Sdo1 = \xi\sin\omega ot-\sqrt{2}m\xi\cos\{(\omega o+\Omega m)t+\pi/4\}$$

The outputs of the product detectors 47 and 48 are $$\begin{aligned} Sa1 &= Sdo1\cdot Cd1 \\ &= \frac{1}{2}\xi\cdot\mu\{\frac{1}{\sqrt{2}}-\cos(2\omega ot+\pi 14)\}+ \\ &\quad \frac{\sqrt{2}}{2}\xi\cdot m\sin\Omega mt - \\ &\quad \frac{\sqrt{2}}{2}\xi\cdot\mu\cdot m\sin\{(2\omega o+\Omega m)t+\pi/2\} \\ Sa2 &= Sdo1\cdot Cd2 \\ &= \frac{1}{2}\xi\cdot\mu\cdot\{\frac{1}{\sqrt{2}}-\cos(2\omega ot-\pi/4)\}+ \\ &\quad \frac{\sqrt{2}}{2}\xi\cdot\mu\cdot m\cos\Omega mt - \\ &\quad \frac{\sqrt{2}}{2}\xi\cdot\mu\cdot m\sin(2\omega o+\Omega m)t \end{aligned}$$

The outputs Sao1 and Sao2 of the phase shifters 50 and 51 are expressed by the equations $$Sao1 = \frac{\sqrt{2}}{2}\xi\cdot\mu\cdot m\sin(\Omega mt+\theta)$$

$$Sao2 = \frac{\sqrt{2}}{2}\xi\cdot\mu\cdot m\sin(\Omega mt+\theta)$$

Those equations show that, in the monophonic broadcast receiving, the same audio signal appears at the output terminals 52 and 53.

The phase shifters 50 and 51 are used to remove the relative phase shift introduced between the right and left audio signals in the transmitter side. However, the use of the phase shifters is not essential in the receiver, In case where the phase shifters are provided in the receiver, it is not necessarily required for the phase shifters in the receiver to have the phase shifting characteristics equal to those of phase shifters in the transmitter, and thus the former phase shifters may be more simple in construction than the later ones.

Figure 8:
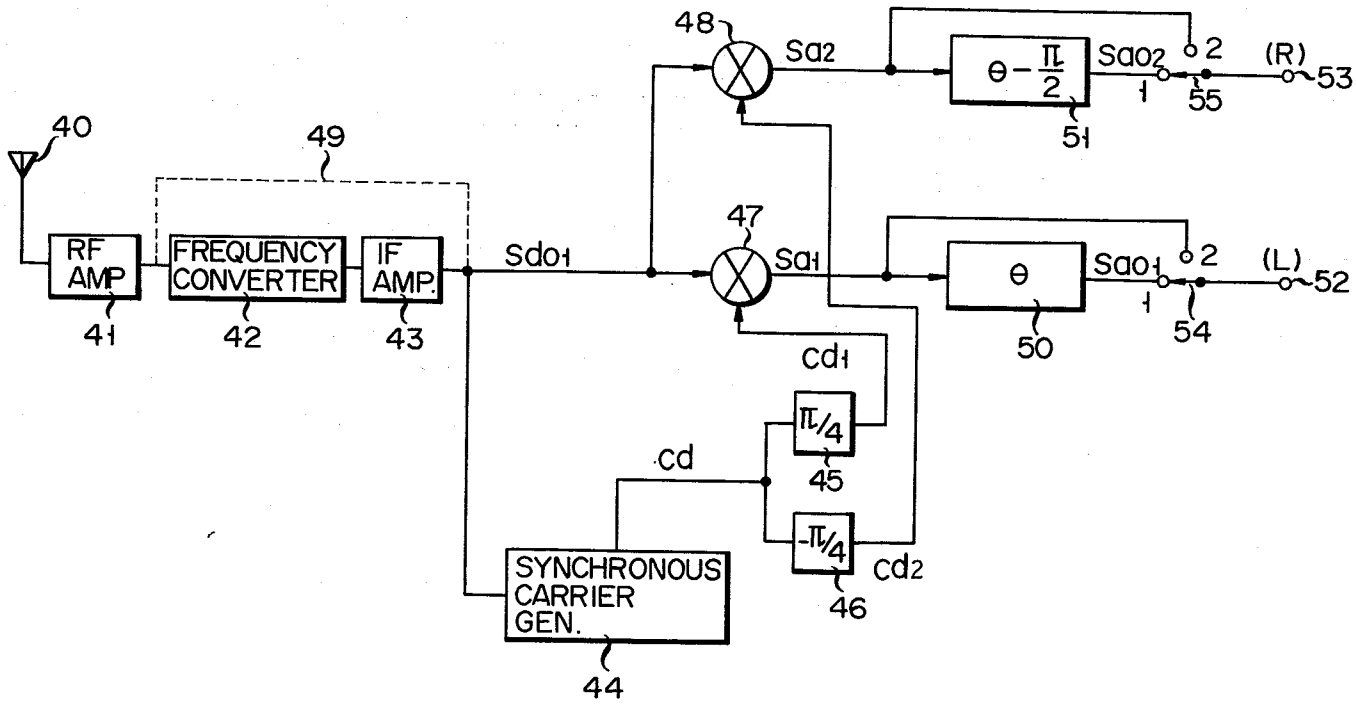
FIG. 8 is a block diagram of an embodiment of an AM stereophonic receiver according to the present invention.

In FIG. 8, the switches 54 and 55 are used to switch the stereophonic and/or monophonic broadcast receiving mode of the invention to the conventional AM broadcast receiving mode and vice versa. The switch positions of the switches in the figure are under the condition permitting the stereo and/or monophonic broadcase receiving mode of the present invention. In the AM broadcast receiving mode, the phase-shift compensation is not necessary so that the outputs of the product detectors 47 and 48 may be coupled with the output terminals 54 and 55, through the switches 54 and 55.

For the conventional AM broadcast receiving, the output *Sdo*1 of the amplifier 43 is $$Sdo1 = (\xi + a\sin\Omega at)\sin\omega ot$$

The outputs S*a*1 and S*a*2 of the product detectors 47 and 48 are given $$Sa1 = Sa2 = \frac{1}{2\sqrt{2}}\, a\xi\sin\Omega at$$

The receiver heretofore described is of a heterodyne type but may be of a homodyne type. In the homodyne receiver, the output of the RF amplifier 41 is directly coupled with the synchronous carrier generator 44, and the product detectors 47 and 48 as shown by a dotted line 49. For homodyne receiver, the voltage-controlled oscillator (VCO) in the PLL circuit constituting a synchronous carrier generator 44 is constructed of a variable frequency type. The frequency of each synchronous carrier Cd, Cd1 and Cd2 generated in the receiver is the same as that of each carrier in the transmitter.

Figure 9:
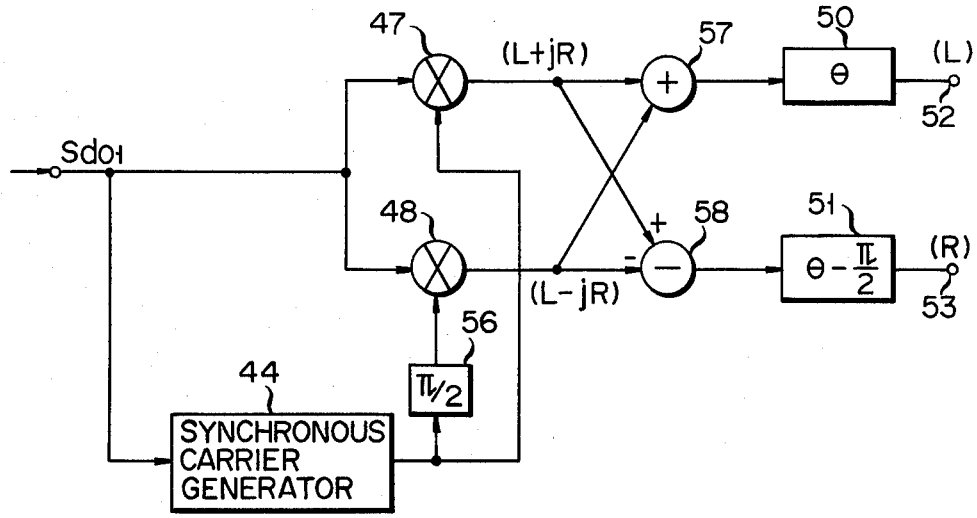
FIG. 9 is a block diagram of another embodiment of the AM stereophonic receiver of the present invention.

Reference is now made to FIG. 9 illustrating another receiver according to the present invention. In this example, the synchronous carrier from the synchronous carrier generator 44 is phase-shifted by 90° by a phase shifter 56. The output signal Sdo1 of the amplifer 43 (FIG. 8) is multiplied by the synchronous carrier from the carrier generator 44 in the product detector 47 where the audio composite signal L + *j*R is produced. The 90° phase-shifted synchronous carrier from the shifter 56 is multiplied by the signal Sdo1 in the product detector 48 where the audio composite signal L − *j*R is produced. The outputs L + *j*R and L − *j*R of the product detectors 47 and 48 are summed in the adder 57 to extract the audio signal L. In the subtractor 58, the output L − *j*R of product detector 48 is subtracted from the output L + *j*R of product detector 47 to extract the right audio signal *j*R. The phase-shifters 50 and 51 provide the right and left audio signals L and R to the output terminals 52 and 53. It is evident that the circuit construction of FIG. 9 may be used for the homodyne type receiver.

The explanation to follow is the compatibility of the stereophonic and/or monophonic broadcast according to the present invention with the conventional envelope detector. The amplitude A1 of the composite signal in the stereophonic broadcast is expressed, with the above-mentioned S*am* 1 and S*am* 2, $$A1 = \sqrt{2}\sqrt{l^2\sin\Omega lt + r^2\cos^2\Omega rt + l\sin\Omega lt + r\cos\Omega rt + \frac{1}{2}}$$
$$= \sqrt{2}\sqrt{(l\sin\Omega lt + \frac{1}{2})^2 + (r\cos\Omega rt + \frac{1}{2})^2}$$

This equation includes the information of the right and left audio signals L and R so that the stereophonic broadcast of the present invention can be received by the conventional AM receiver.

The amplitude A1 of the composite wave in the case of the single-sideband monophonic broadcast is given $$A1 = \sqrt{2}\sqrt{\frac{1}{2} + m^2 + \sqrt{2}m\sin(\Omega mt + \pi/4)}$$
$$= (2A)^{\frac{1}{2}}\{1 + B/A\sin(\Omega mt + \pi/4)\}^{\frac{1}{2}}$$

where $A = 1/2 + m^2$ and $B = \sqrt{2}m$. If $B/A << 1$, $$A1 = (2A)^{\frac{1}{2}}\{1 - \frac{1}{16}(B/A)^2 + \frac{1}{2}\cdot\frac{B}{A}\sin(\Omega mt + \pi/4) + \frac{1}{16}(B/A)^2\cos(2\Omega mt + \pi/2)\ldots\}$$

The third term in this equation, $\frac{1}{2} \times B/A \sin(\phi mt + \pi/4)$, is the signal to be demodulated by the envelope detector. The single-sideband monophonic broadcast signal can be envelope-detected, although being accompanied by a slight harmonic distortion.

What we claim is:

1. A method of producing a broadcast signal for an AM stereophonic transmission system for transmitting stereophonically related first and second audio information signals by an amplitude modulation system, including the steps of:

generating a first carrier component;

generating a first double-sideband component of a second carrier component which is suppressed-carrier amplitude-modulated by said first audio information signal, said second carrier component having the same frequency as that of said first carrier component and being advanced in phase by substantially 45° with respect to said first carrier component; and generating a second double-sideband component of a third carrier component which is suppressed-carrier amplitude-modulated by a second audio information signal phase-shifted by substantially 90° relative to said first audio information signal, said third carrier component having the same frequency as that of said first carrier component and being retarded in phase by substantially 45° with respect to said first carrier component.

2. In an AM stereophonic transmission system, a transmitter comprising:

a source of stereophonically related first and second audio information signals;

phase shift means for phase shifting the first and second audio information signals to provide a relative phase shift of substantially 90° therebetween;

means for summming the phase shifted first and second audio information signals to produce a sum of the phase shifted first and second audio information signals;

means for producing a difference of the phase shifted first and second audio information signals;

means for generating first and second carriers having a relative phase shift of 90° therebetween;

first modulation means for amplitude-modulating said first carrier from said carrier generating means by said sum of the phase shifted first and second audio information signals;

second modulation means for double-sideband suppressed-carrier, amplitude-modulating said second carrier signal from said carrier signal generating means by said difference of the phase shifted said first and second audio information signals; and means for composing output signals of said first and second modulation means.

3. A stereophonic transmission system according to claim 2, in which said composing means includes summing means.

4. A stereophonic transmission system according to claim 2, in which said composing means includes subtraction means.

5. In an AM stereophonic transmission system, a transmitter comprising:

a source of stereophonically related first and second audio information signals;

phase shift means for phase shifting the first and second audio information signals to provide a relative phase shift of 90° therebetween;

means for generating first, second and third carrier signals, said second and third carrier signals being phase-shifted relative to said first carrier signal by +45° and −45°, respectively;

first modulation means for double-sideband, suppressed-carrier, amplitude-modulating said second carrier signal by the phase shifted first audio information signal;

second modulation means for double-sideband, suppressed-carrier, amplitude-modulating said third carrier signal by the phase shifted second audio information signal; and summing means for summing the output signals of said first and second modulation means and said first carrier signal from said carrier signal generating means.

6. A receiver for reproducing stereophonically related first and second audio information signals from a broadcast signal including a first carrier component, a first double sideband component of a second carrier component suppressed-carrier, amplitude-modulated by the first audio information signal, said second carrier component being advanced in phase by substantially 45° with respect to said first carrier component, and a second double-sideband component of a third carrier component being suppressed-carrier amplitude-modulated by the second audio information phase-shifted by substantially 90° relative to the first audio information signal, said third carrier component being retarded in phase by substantially 45° with respect to said first carrier component, said receiver comprising:

synchronous carrier generating means for generating synchronous carriers in response to the broadcast signal received by an antenna; and means for demodulating said first and second audio information signals in response to said synchronous carriers from said synchronous carrier generating means and said braodcast signal received by the antenna, said means for demodulating comprising:

phase-shift means for phase shifting a first synchronous carrier from said synchronous carrier generating means to produce a second and third synchronous carriers, said second and third synchronous carrier being advanced and retarded in phase by 45° with respect to said first synchronous carrier, respectively;

first demodulation means for demodulating said first audio information signal in response to the broadcast signal received by the antenna and said second synchronous carrier; and second demodulation means for demodulating the second audio information signal phase-shifted by substantially 90° relative to said first audio information signal in response to said third synchronous carrier and the broadcast signal.

7. A receiver according to claim 6, in which each of said first and second demodulation means includes a product detector.

8. A receiver according to claim 6, further comprising phase-shift means connected with the outputs of said first and second demodulation means for reducing the relative phase shift between said first and second audio information signals.

9. A receiver for reproducing stereophonically related first and second audio information signals from a broadcast signal including a first carrier component, a first double-sideband component of a second carrier component suppressed-carrier, amplitude-modulated by the first audio information signal, said second carrier component being advanced in phase by substantially 45° with respect to said first carrier component; a second double-sideband component of a third carrier component suppressed-carrier amplitude-modulated by a second audio information signal phase-shifted by substantially 90° relative to said first audio information signal, said third carrier component being retarded in phase by 45° with respect to said first carrier component, said receiver comprising:

frequency converting means for converting said broadcast signal received by an antenna into an intermediate frequency signal;

synchronous carrer generating means coupled to said frequency converting means for generating synchronous intermediate frequency carriers in response to said intermediate frequency signal; and demodulation means coupled with said frequency converting means and said synchronous carrier generating means for demodulating said first and second audio information signals, said demodulation means including:

phase-shift means for phase shifting a first intermediate frequency carrier from said synchronous carrier generating means to provide a second and third intermediate carriers, said second and third intermediate frequency carriers being advanced and retarded in phase by substantially 45° with respect to said first intermediate frequency carrier, respectively;

first demodulation means for demodulating said first audio information signal in response to the output signal from said frequency converting means and said second intermediate frequency carrier; and second demodulation means for demodulating said second audio information signal phase shifted by 90° relative to said first audio information signal in response to the output signal of said frequency converting means and said second intermediate frequency carrier.

10. A receiver according to claim 9, in which said first and second demodulation means each include a product detector.

11. A receiver according to claim 9 further including phase shifting means connected with the outputs of said first and second demodulation means to reduce the relative phase shift between said first and second audio information signals.

12. A receiver for reproducing stereophonically related first and second audio information signals from a broadcast signal including a first carrier component, a first double-sideband component of a second carrier component suppressed-carrier, amplitude-modulated by the first audio information signal, said second carrier component being advanced in phase by substantially 45° with respect to said first carrier component; a second double-sideband component of a third carrier component suppressed-carrier amplitude-modulated by a second audio information signal phase-shifted by substantially 90° relative to said first audio information signal, said third carrier component being retarded in phase by 45° with respect to said first carrier component, said receiver comprising:

frequency converting means for converting said broadcast signal received by an antenna into an intermediate frequency signal;

synchronous carrier generating means coupled to said frequency converting means for generating synchronous intermediate frequency carriers in response to said intermediate frequency signal; and demodulation means coupled with said frequency converting means and said synchronous carrier generating means for demodulating said first and second audio information signals, said demodulation means comprising:

phase shifting means for phase shifting a first intermediate frequency carrier from said synchronous carrier generating means by substantially 90° to produce a second intermediate frequency synchronous carrier;

first demodulation means for forming a first audio composite signal in response to the output signal of said frequency converting means and said first intermediate frequency carrier from said synchronous carrier generating means;

second demodulation means for forming a second audio composite signal in response to the output signal of said frequency converting means and a second intermediate frequency carrier from said phase shifting means;

summing means coupled to the outputs of said first and second demodulating means for reproducing said first audio information signal by summing said first and second audio composite signals; and subtraction means coupled to the outputs of said first and second demodulation means for reproducing said second audio information signal phase shifted by 90° relative to said first audio information signal by making a difference between said first and second audio composite signals; and further comprising phase shifting means coupled with the outputs of said summing means and subtraction means to reduce the relative phase shift between said first and second information signals.

13. A receiver according to claim 12, in which said first and second demodulation means each include a product detector.

14. A receiver for reproducing stereophonically related first and second audio information signals from a broadcast signal including a first carrier component, a first double sideband component of a second carrier component suppressed-carrier, amplitude-modulated by the first audio information signal, said second carrier component being advanced in phase by substantially 45° with respect to said first carrier component, and a second double-sideband component of a third carrier component being suppressed-carrier amplitude-modulated by the second audio information phase-shifted by substantially 90° relative to the first audio information signal, said third carrier component being retarded in phase by substantially 45° with respect to said first carrier component, said receiver comprising:

synchronous carrier generating means for generating synchronous carriers in response to the broadcast signal received by an antenna; and means for demodulating said first and second audio information signals in response to said synchronous carriers from said synchronous carrier generating means and said broadcast signal received by the antenna, said means for demodulating comprising:

phase shift means for phase shifting a first synchronous carrier from said synchronous carrier generating means by 90° to produce a second synchronous carrier;

first demodulation means for producing a first audio composite signal is response to the broadcast signal received by the antenna and said first synchronous carrier;

second demodulation means for producing a second audio composite signal is response to the broadcast signal received by the antenna and said second synchronous carrier;

adding means for adding together said first and second audio composite signals to reproduce said first audio information signal; and subtracting means for subtracting one of said first and second audio composite signals from the other to reproduce said second audio information signal phase-shifted by 90° relative to said first audio information signal; and further including phase shifting means coupled with the outputs of said adding means and subtracting means to reduce the relative phase shift between said first and second audio information signals.

15. A receiver according to claim 14, in which said first and second demodulation means each include a product detector.

* * * * *